US006379184B1

(12) United States Patent
Bassler et al.

(10) Patent No.: US 6,379,184 B1
(45) Date of Patent: Apr. 30, 2002

(54) CONNECTORS WITH REDUCED NOISE CHARACTERISTICS

(75) Inventors: Maxwill P. Bassler, Hampshire; David L. Brunker, Naperville; Daniel L. Dawiedczyk, Lisle; John E. Lopata, Naperville, all of IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/356,206

(22) Filed: Jul. 16, 1999

(51) Int. Cl.[7] ..... H01R 13/648

(52) U.S. Cl. ..... 439/607; 439/620; 439/941; 439/955

(58) Field of Search ..... 439/607, 608, 439/620, 941, 108, 955

(56) References Cited

U.S. PATENT DOCUMENTS 5,601,451 A * 2/1997 Driones et al. ..... 439/490
5,637,014 A 6/1997 Sukegawa et al. ..... 439/607
5,639,267 A * 6/1997 Loudermilk ..... 439/607
5,736,910 A 4/1998 Townsend et al. ..... 333/181
6,036,544 A * 3/2000 Brunker et al. ..... 439/620

FOREIGN PATENT DOCUMENTS

EP 0 514 055 A2 11/1992 ..... H01R/9/09
EP 0 907 225 A2 4/1999 ..... H01R/23/00
JP 04206652 7/1992 ..... H01L/23/32

* cited by examiner

*Primary Examiner*—Tulsidas Patel
*Assistant Examiner*—Phuong Dinh
(74) *Attorney, Agent, or Firm*—Robert J. Zeitler; Thomas D. Paulius

(57) ABSTRACT

A connector having reduced noise characteristics is provided having an electronic component, such as a capacitor, electrically connecting together the power ground and power voltage terminals of the connector, with the electronic component being located within the connector housing. Such a structure reduces any induced electrical noise from occurring in the signal terminals of the connector due to the power terminals.

11 Claims, 13 Drawing Sheets

CONNECTORS WITH REDUCED NOISE CHARACTERISTICS

BACKGROUND OF THE INVENTION

The present invention relates generally to connectors and more particularly to input-output style connectors, including connectors that are used to connect signal cables, especially high-speed signal cables, to an electronic device, such as a computer.

Many electronic devices, such as computers, include transmission lines to transmit signals from peripheral devices such as a video cameras, compact disc players or the like to the motherboard of the computer. These transmission lines incorporate signal cables that are capable of high-speed data transmissions. In most applications, the signal cable extends from either the peripheral device itself or a connector on the peripheral device to a connector mounted on the motherboard. These connectors are quite small in keeping with the trend toward reduced size of electronic devices. The size of such connectors may typically be about 8 mm by 6 mm, thereby leaving a connector designer only 48 $mm^2$ of area in which to develop appropriate connector structure and components in order achieve a desired level of performance of the connector.

Signal cable construction may use what are known as one or more twisted pairs of wires that are twisted together along the length of the cable, with each such twisted pair being encircled by an associated grounding shield. These twisted pairs typically receive complimentary signal voltages, i.e., one wire of the pair may see a +1.0 volt signal, while the other wire of the pair may see a −1.0 volt signal. As signal cables are routed within a computer, they may pass by or near electronic devices on the computer motherboard which create their own electric field. These devices have the potential to create electromagnetic interference to transmission lines such as the aforementioned signal cables. However, this twisted pair construction minimizes or diminishes any induced electrical fields and thereby eliminates electromagnetic interference.

In one current application, these signal cables are manufactured in three different speeds for use with peripheral devices and these three speeds are 800, 1600 and 3200 megabits per second. If the speed of the cable is known to the electronic device, the device may switch to various internal circuits to match the transmission speed capability of the cable. It is therefore desirable to incorporate a means to determine the speed of the cable into the connector itself.

In order to maintain electrical performance integrity from the cable to the circuitry of the device, it is further desirable to obtain a substantially constant impedance throughout the transmission line, from circuit to circuit and to avoid large discontinuities in the impedance of the transmission line. It is known that it is difficult to control the impedance of a connector inasmuch as the impedance of a conventional connector typically drops through the connector and across the interface of the two mating connector components. It is therefore desirable to maintain a desired impedance throughout the connector and its connection to the circuit board.

The present invention is therefore directed to a cable connector for providing a connection between high-speed cables and a printed circuit board that provides a reliable connection with a high level of performance.

SUMMARY OF THE INVENTION

Accordingly, it is a general object of the present invention to provide an improved connector for high-speed data transmission connections in which the impedance discontinuity through the connector is minimized so as to better attempt to match the impedance of the transmission line.

Another object of the present invention is to provide a connector for use in conjunction with signal cables that provides a connection between two twisted pairs of wires of the cable, the connector having an improved electrical performance due to its structure, thereby eliminating the need to modify circuitry on the circuit board to which the connector is mounted in order to save space on the circuit board and reduce manufacturing costs.

A further object of the present invention is to provide an improved connector for effecting a connection between a transmission line having at least one pair of differential signal wires and an associated ground and like connections on a circuit board, wherein the connector includes two signal terminals for contacting opposing signal terminals terminated to the differential signal wires and a ground terminal disposed adjacent to the signal terminals for contacting an opposing ground terminal of the associated ground in order to provide a contact ground reference throughout the connector and onto the circuit board.

It is a further object of the present invention to provide such a connector wherein, by varying the size of the ground terminal and its location relative to its two associated signal wires, the impedance of the connector may be "tuned" to obtain a preselected impedance through the connector.

Yet another object of the present invention is to provide a connector for connecting cables, such as those of the IEEE 1394 type, to a circuit board of an electronic device, wherein the connector has a number of discrete, differential signal wires and associated grounds equal in number to those contained in the cables, the ground terminals of the connector being configured in size and location with respect to the signal terminals of the connector in order to minimize the drop in impedance through the connector.

Another object of the present invention is to provide a connector assembly of interengaging first and second connectors wherein the first connector includes a means in determining status information, such as for example, the transmission speed of a high speed cable, and the second connector having a terminal to convey such status information to a circuit on the circuit board.

Yet still another object of the present invention is to provide an input-output connector assembly having interengaging plug and receptacle connectors that when engaged, provide a connection between a cable and a printed circuit board, wherein one of the connectors is terminated to the cable and the other connector is terminated to the circuit board, the one connector having means for conveying status information of the cable through the other connector to the circuit board, such as the speed of the cable, the one connector including a nest formed in the housing thereof, and the nest having an electronic component for interconnecting a status information terminal with an associated terminal of the one connector, the component affecting a signal transmitted through the other terminal in a manner that indicates the status information to circuitry on the circuit board.

A still further object of the present invention is to provide a connector having a socket end for receiving a corresponding plug portion of a signal cable, the socket having inner and outer shields spaced apart from each other to facilitate levels of connection, including isolation, direct galvanic connection and electronic networks.

Another object of the present invention is to provide an improved connector having a double shield structure, with inner and outer shields being separated by an intervening insulator, the connector including an electronic network interconnecting the inner and outer shields together that may be used to block DC current flow between the shields, to dissipate electrostatic charges acquired by the connector and/or to limit overvoltage conditions, etc.

In order to obtain the aforementioned objects, one principal aspect of the invention that is exemplified by one embodiment thereof includes a first connector structure which has a housing that supports, for each twisted pair of wires in the mating signal cable, three conductive terminals in a unique pattern of a triplet, with two of the terminals carrying differential signals, and the remaining terminal being a ground terminal that serves as a ground reference to the differential pair of signal wires. A second connector is provided that mates with the first connector and this second connector also has a triplet pattern of conductive terminals that are terminated to signal and ground wires of the cable.

The arrangement of these three terminals within the connector permits the impedance to be more effectively controlled throughout the first connector, from the points of engagement with the cable connector terminals to be points of attachment to the circuit board. In this manner, each such triplet includes a pair of signal terminals that are aligned together in side-by-side order, and which are also spaced apart a predetermined distance from each other. A contact portion of the ground terminal extends in a different plane than that of like portions of the signal terminals, while the remainder of the ground terminal extends between the signal terminals, but in the same plane as the signal terminals.

The width of this ground terminal contact portion and its spacing from the signal terminals may be chosen so that the three terminals may have desired electrical characteristics such as capacitance and the like, which affects the impedance of the connector. By this structure, a greater opportunity is provided to reduce the impedance discontinuity which occurs in a connector without altering the mating positions or the pitch of the differential signal terminals. Hence, this aspect of the present invention may be aptly characterized as providing a "tunable" terminal arrangement for each twisted pair and ground reference wire arrangement found in either a cable or in other circuits.

In another principal aspect of the present invention, two such tunable triplets may be provided within the connector housing, but separated by an extent of dielectric material, such as the connector housing, an air gap, or both. In order to maximize the high speed performance of the connector, the signal and ground terminals are preferably all similarly flat contacts that are cantilevered from their associated body portions so that the ground terminal contact portions may be selectively sized with respect to their associated signal terminals to facilitate the-tuning of the terminals to obtain the optimum desired impedance. When two such triple terminal sets are utilized in the connectors of the present invention, the power terminals of the connector may be situated between the two triple terminal sets at a level equal to that of the ground terminals so as not to interfere with the signal terminals.

In another principal aspect of the present invention, one of the interengaging connectors may be provided with multiple shields arranged in an inner and outer relationship and separated by an intervening insulative member. These two shields, on one embodiment, include a series of tabs to which electronic components may be applied to form a desired return. In another embodiment of this two-shield concept, the two shields may be interconnected by a circuit board, conventional, flexible or other onto which preselected electronic components may be added. In still another embodiment, the inner shield may be formed as part of the outer shield so that a direct connection is obtained between the two shields. In yet another embodiment, the inner shield may have mounting feet interior of the mounting feet of the outer shield.

In still another principal aspect of the present invention, and as exemplified by another embodiment thereof, a status information detection feature is provided within the confines of a plug connector that identifies certain information on the status of a cable, circuit, or other component connected to the plug connector, to the circuit board of the electronic device. The status information may pertain to the speed of the cable terminated to the plug connectors and may serve to identify one of three typical cable speeds: 800, 1600 or 3200 megabits per second.

In this type of construction, one or more terminals of the plug connector are dedicated to the status information aspect. The housing of the plug connector may be provided with a nest, or recess, that extends between a terminal dedicated to status information and another terminal, such as the power ground terminal. The nest holds an electronic component such as a resistor, a capacitor or the like in an orientation so that the electronic component bridges, or shorts, the two aforementioned terminals. The status terminal of the plug connector is engaged by an opposing status terminal located in an opposing mating connector. This status terminal is terminated to the circuit board so that the status information terminal of the plug connector, in effect, completes a selected status circuit of the circuit board.

When a resistor is used as the bridging component, the circuit board circuitry may read voltage passed through the status terminal and read its value to determine the speed of the cable. When the electronic bridging component is a capacitor, the circuit board circuitry is able to read the voltage rise over time transmitted through the status terminal and thereby determine the cable speed.

In still another principal aspect of the present invention, a noise reduction feature is incorporated by capacitively coupling the power out and return terminals of the connector together in order to maintain them at the same potential during operation of high speed data transmission. A capacitor is used to couple these two terminals together which facilitates AC current flow, while blocking DC or steady state current flow.

These and other objects, features and advantages of the present invention will be clearly understood through consideration of the following detailed description.

BRIEF DESCRIPTION OF THE DRAWINGS

In the course of the following detailed description, reference will be made to the accompanying drawings wherein like reference numerals identify like parts and in which.

DETAILED DESCRIPTION OF PREFERRED EMBODIMENTS

The present invention, as explained above, is directed to an improved connector that is particularly useful in enhancing the performance of high-speed cables, particularly in input-output ("I/O") applications as well as other type of applications.

Many peripheral devices associated with an electronic device, such as a video camera or camcorder, transmit digital signals at various frequencies. Other devices associated with a computer,.such as the CPU portion thereof, operate at high speeds for data transmission. High speed cables are used to connect these devices to the CPU and may also be used in some applications to connect two or more CPUs together. A particular cable may be sufficiently constructed to convey high speed signals and may include differential pairs of signal wires, either as twisted pairs or individual pairs.

One key consideration in high speed data transmissions is signal degradation. This involves crosstalk and signal reflection which is affected by the impedance of the cable and connector. Crosstalk and signal reflection may be controlled easy enough in a cable by shielding and the use of differential pairs of signal wires, but they are harder to control in a connector by virtue of the various and diverse materials used in the connector, among other considerations. The physical size of the connector in high speed applications limits the extent to which the connector and terminal structure may be modified to obtain a particular electrical performance.

Impedance mismatches in a transmission path can cause signal reflection, which often leads to signal losses, cancellation, etc. Accordingly, it is desirable to keep the impedance consistent over the signal path in order to maintain the integrity of the transmitted signals. The connector to which the cable is terminated and which supplies a means of conveying the transmitted signals to circuitry on the printed circuit board of the device is usually not very well controlled insofar as impedance is concerned and it may vary greatly from that of the cable. A mismatch in impedances between these two elements may result in transmission errors, limited bandwidth and the like.

Figure 11:
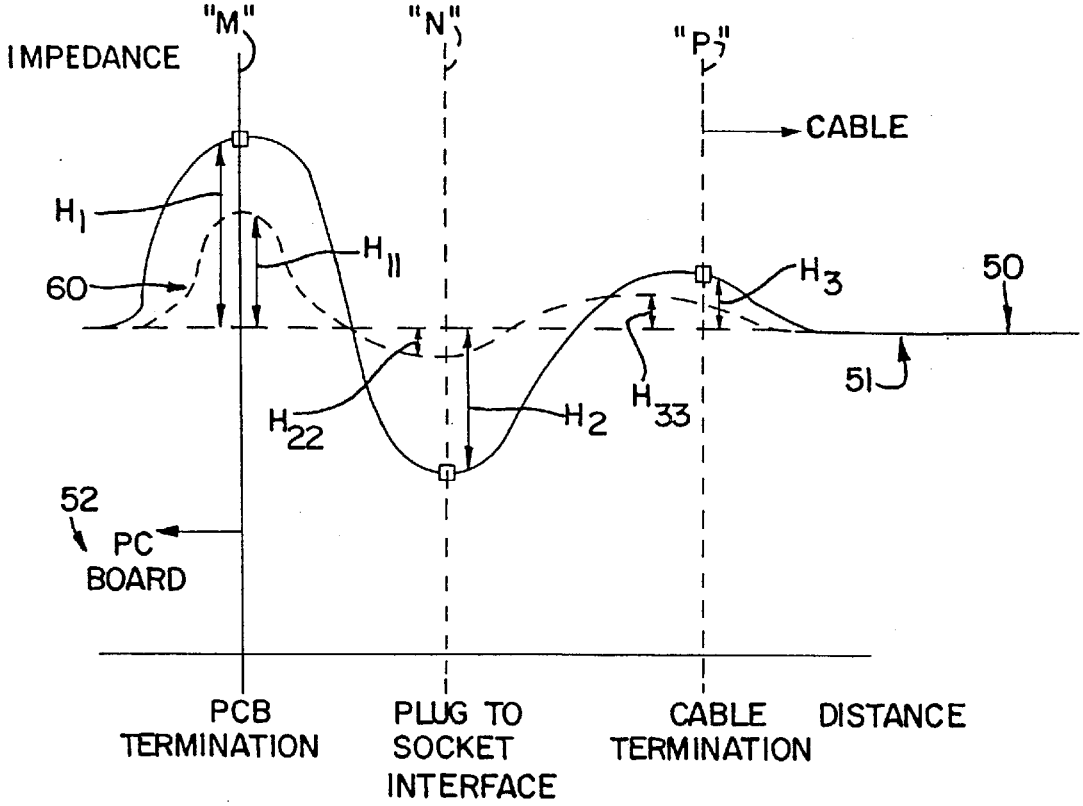
FIG. 11 is a diagram illustrating the typical impedance discontinuity experienced with a high-speed cable connection and also the reduction in this discontinuity that would be experienced with the connectors of the present invention.

Turning to FIG. 11, the impedance discontinuity that occurs through a conventional plug and receptacle connector assembly used for signal cables is shown by the solid line at 50. The impedance through the signal cable approaches a constant, or baseline value, as shown to the right of FIG. 11 at 51. The cable impedance substantially matches the impedance of the circuit board at 52 shown to the left of FIG. 1 1 and to the left of the "PCB Termination" axis. That vertical axis "M" represents the point of termination between the socket or receptacle connector and the printed circuit board, while the vertical axis "N" represents the interface that occurs between the two mating plug and socket connectors, and the vertical axis "P" represents the point where the plug connector is terminated to the cable.

The curve 50 of FIG. 11 represents the typical impedance "discontinuity" achieved with conventional connectors and indicates three peaks and valleys that occur, with each such peak or valley having respective distances (or values) $H_1$, $H_2$ and $H_3$ from the baseline as shown. These distances are measured in ohms with the base of the vertical axis that intersects with the horizontal "Distance" axis having a zero (0) ohm value. In these conventional connector assemblies, the high impedance as represented by $H_1$, will typically increase to about 150 ohms, whereas the low impedance as represented by $H_2$ will typically decrease to about 60 ohms. This wide discontinuity between $H_1$ and $H_2$ of about 90 ohms affects the electrical performance of the connectors with respect to the printed circuit board and the cable.

The present invention pertains to a connector particularly useful in I/O ("input-output") applications that has an improved structure that permits the impedance of the connector to be set so that it emulates the cable to which it is mated and reduces the aforementioned discontinuity. In effect, connectors of the present invention may be "tuned" through their design to improve the electrical performance of the connector.

Impedance Tunability

Figure 1A:
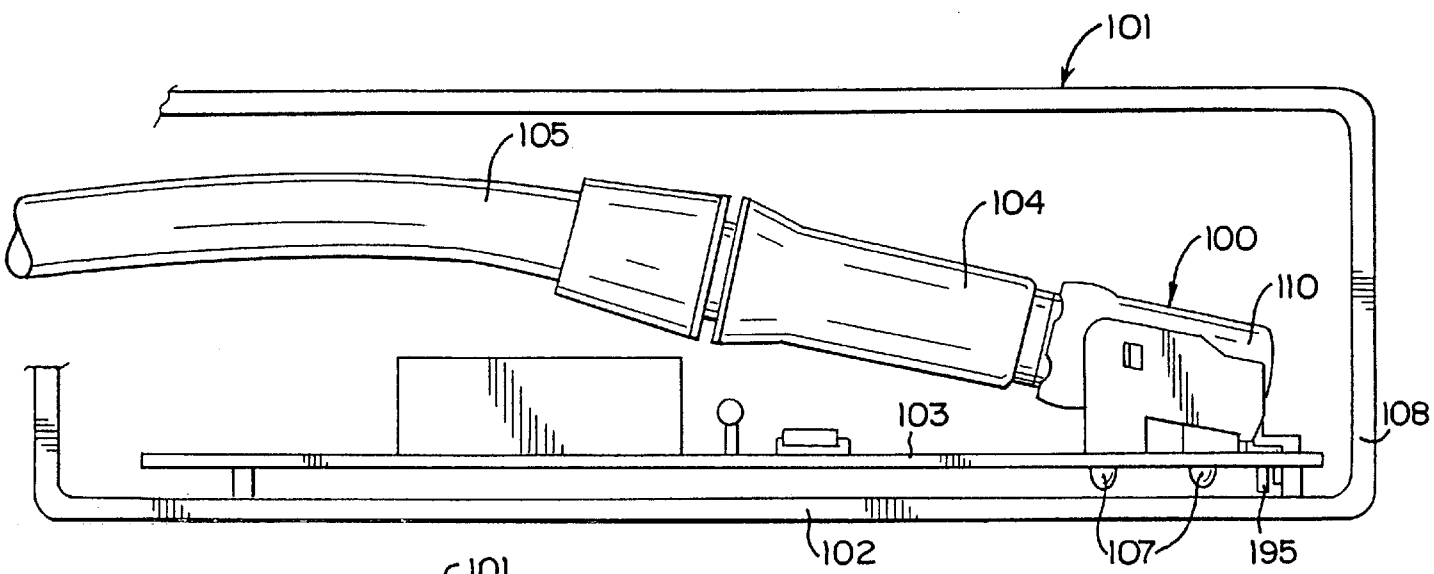
FIG. 1A is an elevational view of a cable connector assembly of the invention in place on a circuit board of an electronic device illustrating an "internal" environment in which the present invention has utility.
Figure 1B:
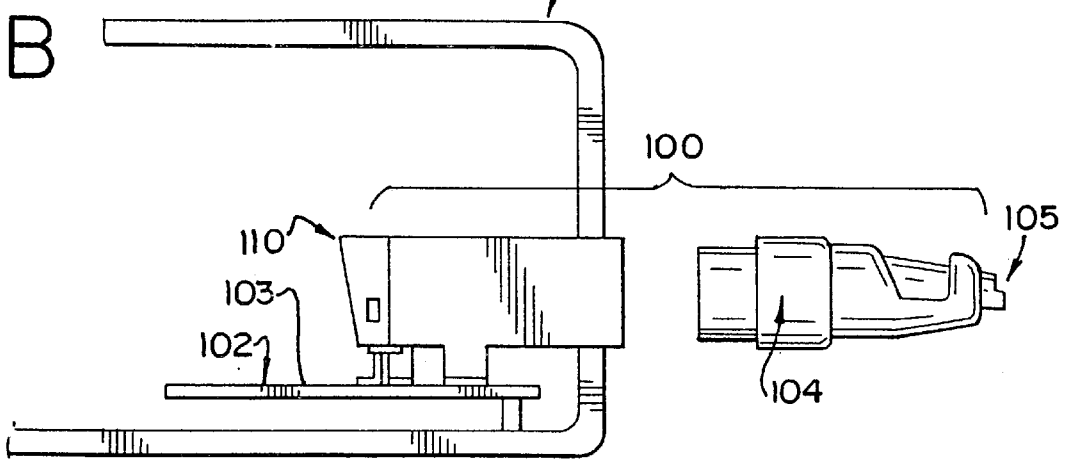
FIG. 1B is an elevational view of a cable connector assembly :of the invention in place on a circuit board of an electronic device and extending to the exterior of the device to illustrate an "external" environment in which the present invention has utility.

Turning to FIG. 1A, one "internal" environment is depicted in which the present invention finds significant utility. In this environment, the connectors of the present invention are disposed inside of the exterior wall 108 of an electronic device, such as a computer 101. Hence, the reference to "internal." The connectors of the present invention may also be used in an "external" application, as illustrated in FIG. 1B, wherein one of the connectors 110 is mounted to the circuit board 102, but extends partly through the exterior wall 108 of the device 101 so that it may be accessed by a user from the exterior of the device 101. The connector assembly 100 includes a pair of first and second interengaging connectors, described here in as respective receptacle (or socket) connectors 110 and plug connectors 104. One of these two connectors 110 is mounted to the printed circuit board 102 of the device 101, while the other connector 104 is typically terminated to a cable 105 that leads to a peripheral device.

Figure 2:
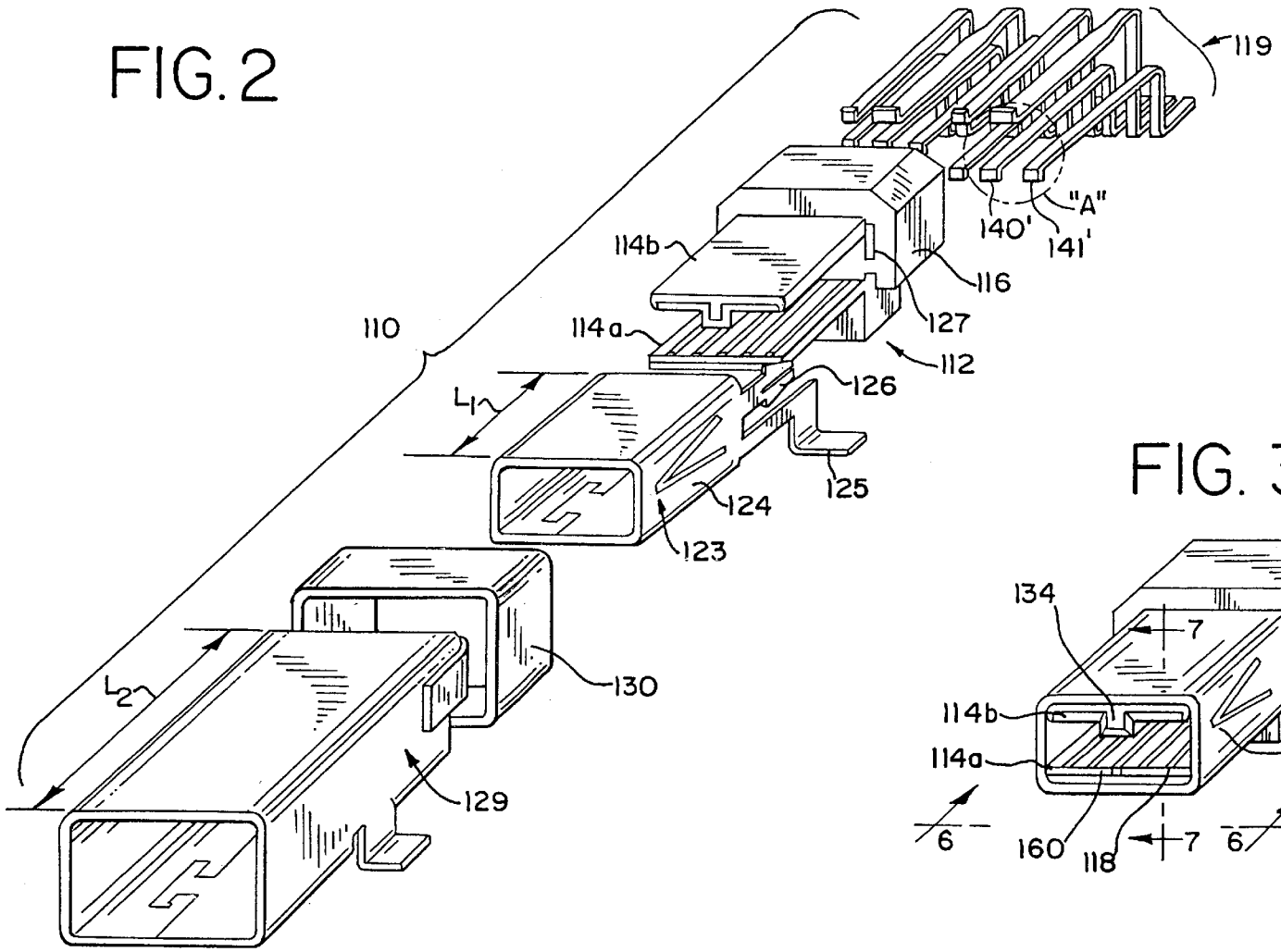
FIG. 2 is an exploded view of a cable connector in the form of a socket connection constructed in accordance with the principles of the present invention that is suitable for mounting onto a printed circuit board and opening to either the interior or exterior of the electronic device.
Figure 3:
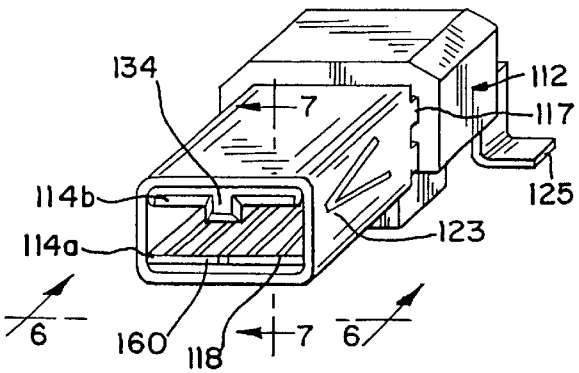
FIG. 3 is a perspective view of the socket connector and inner shield of the connector of FIG. 2.

FIG. 2 is an exploded view of a receptacle, or socket connector, 110 constructed in accordance with the principles of the present invention. The connector 110 is seen to include an insulative connector housing 112 that is formed from a dielectric material. In the embodiment depicted, the housing 112 has two leaf portions 114*a*, 114*b* that extend out from a body portion 116 of the housing 112. These housing leaf portions support a plurality of conductive terminals 119 as shown. In this regard, the lower leaf portion 114*a* has a series of grooves, or slots 118, formed therein that are adapted to receive selected ones of the conductive terminals 119 therein. The upper leaf portion 114*b*, has similar grooves 120 (FIGS. 6 & 7) that receive the remaining terminals 119 of the connector 110.

In order to provide overall shielding to the connector housing 112 and its associated terminals 119, the connector may include a first shell or shield 123 that is formed from sheet metal having a body portion 124 that encircles the upper and lower leaf portions 114*a*, 114*b* of the body portion 116. This first shield 123 may also include foot portions 125 for mounting to the surface 103 of the printed circuit board 102 and which provide a connection to a ground on the circuit board. Depending foot portions 107 may also be formed with the shield as illustrated in FIG. 1 for use in through-hole mounting of the connector 110, although surface mounting applications are preferred. The first shield 123 may, as shown in FIG. 2, include retention members 126 that are received within and which engage slots 127 formed in the connector body portion 116.

The structure of the socket connector 110 illustrated in FIG. 2 permits it to be used in the "internal" application shown in FIG. 1, as well as in external applications where the connector 110 is mounted to the circuit board 102, but where the connector 110 extends particularly through and is accessible from an exterior wall 108 of the electronic device.

As mentioned earlier, one of the objects of the present invention is to provide a connector having an impedance that more closely resembles that of the system (such as the cable) impedance than is typically found in multi-circuit connectors. The present invention accomplishes this by way of what shall be referred to herein as a tunable "triplet," which is an arrangement of three distinct terminals shown at "A" in FIGS. 2, 5A, 5B & 6. In its simplest sense, and as shown in FIG. 5A, such a triplet-involves two signal terminals 140, 141 and a single ground terminal 150 that are arranged to mate with corresponding terminals of the plug connector 104 that are terminated to the wires of a differential pair of wires (preferably a twisted pair of wires) TPA+, TPA−, shown schematically in FIGS. 9A & 9B which carry the same strength signals but which are complements of each other, i.e., +1.0 volts and −1.0 volts as well as a ground complement.

Figure 7:
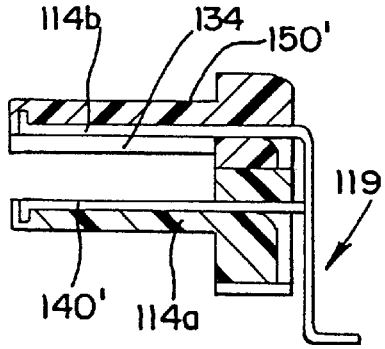
FIG. 7 is a cross-sectional view taken along lines 7—7 of FIG. 3, illustrating the receptacle connector body and the separation of the two rows of terminals thereof.
Figure 8A:
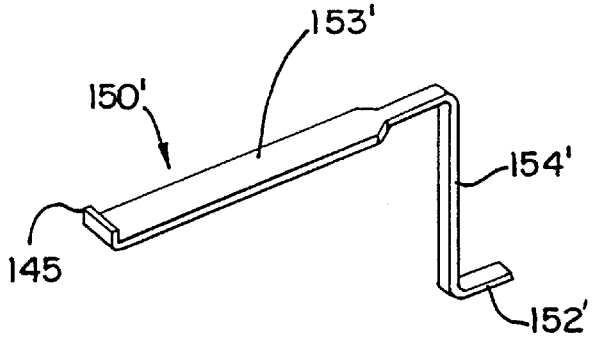
FIG. 8A is a perspective view of a ground terminal utilized in the receptacle connectors of FIGS. 2–3 and 6–7.
Figure 8B:
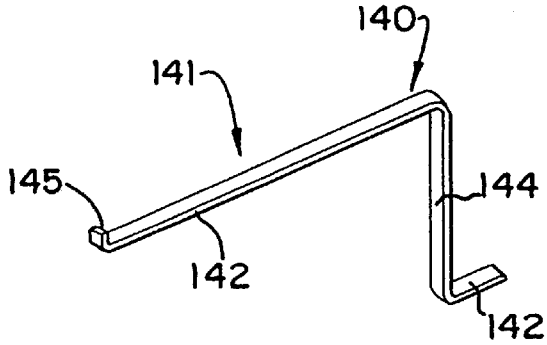
FIG. 8B is a perspective view of a signal terminal utilized in the receptacle connectors of FIGS. 2–3 and 6–7.

As shown best in FIG. 8B, the two signal terminals 140, 141 may have a cantilevered design where each terminal 140, 141 has a surface mount foot portion 142, a contact blade portion 143, and an interconnecting body portion 144. With this design, the terminals 140, 141 may be easily stamped and formed. The terminals 140, 141 are received within slots 118 of the lower leaf 114*b* of the housing body portion 116 and may include, as shown in FIGS. 2 & 7, endtabs 145 at the free ends of the contact blade portions 143 that are received in openings 117 formed in the connector housing body 116 at the ends of the slots 118. In order to "tune" the electrical characteristics of the connector and more closely resemble the impedance of the system, a single ground terminal 150 is provided in association with each set of differential signal terminals 140, 141. Hence, the term "triplet."

Figure 9A:
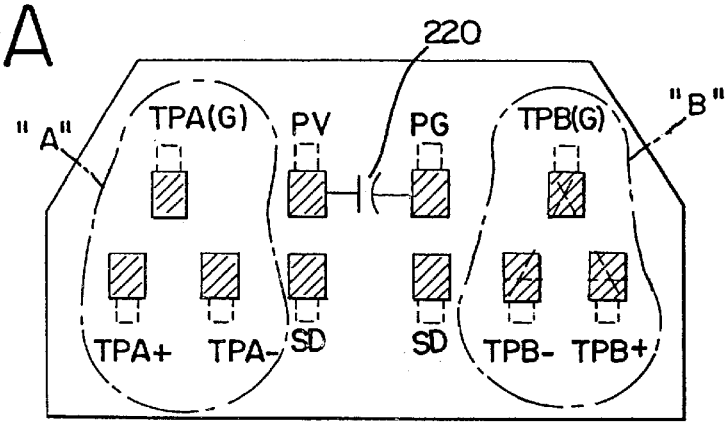
FIG. 9A is a schematic end view of the connectors of FIGS. 2–4, 6–7 and 12 generally illustrating the arrangement of the various terminals relative to each other, and illustrating the use of two status information terminals.
Figure 9B:
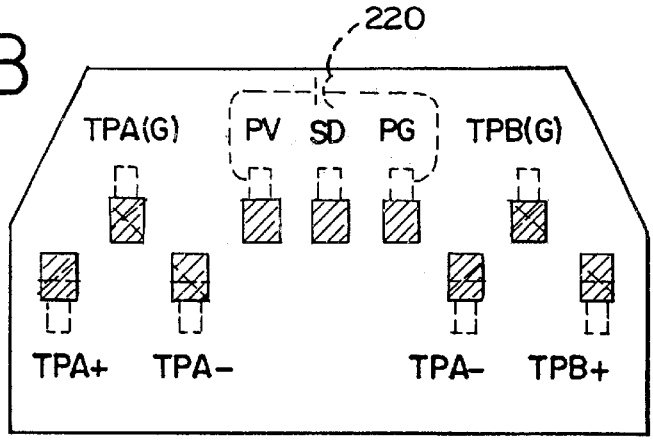
FIG. 9B is a schematic end view of the connectors of FIGS. 13, 14A & B and 17 generally illustrating the arrangement and identification of the terminals and showing the use of one status information terminal.

Each such ground terminal, as shown in detail "A" of FIGS. 5A, 5B and 9A, 9B is associated with two differential signal terminals. The schematic diagrams of FIGS. 9A and 9B illustrate the triple terminal concept at "A" and "B". In the embodiments illustrated, the ground terminal 150 is located on the upper leaf portion 114*b* of the receptacle connector body 116 and between the two signal terminals 140, 141. In the schematics shown in FIGS. 9A & 9B, two such triplets are shown, with the individual terminals being identified with either an "A" or "B" suffix. Thus, TPA+and TPA-represent the terminals for the differential signal wires of the "A" pair of wires, while TPA(G) represents the ground terminal for the "A" set of wires. Likewise, TPB+ and TPB− represent the terminals of the differential signal wires of the "B" pair of wires in the cable, while TPB(G) represents the ground terminal of the "B" wire set.

This associated ground terminal 150, as shown in FIG. 8A, also has a cantilevered design with a surface mount foot portion 152, an intermediate body portion 154 and a contact blade portion 153. As with the signal terminals, the contact blade portion 153 of the ground terminal 150 lies in a different plane than that of its intermediate body portion 154. As seen best in FIGS. 2, 8A, 8B, and 9C the contact blade portions 143, 153 of the signal and ground terminals lie in different, but intersecting planes than their respective terminal body portions 144, 154. Although the preferred embodiment illustrates these two planes as being generally perpendicular horizontal and vertical planes, it will be understood that such planes need not be perpendicularly intersecting or lying in exact horizontal and vertical planes to effect the advantages of the invention. The terminals shown have flat cross-sections. Round wire configurations may also be used in the connectors. It is desirable, however, that the two planes intersect with each other.

Still further, the surface mount portions 142, 152 of the signal and ground terminals 140, 141, 150 may lie in a plane generally parallel to that of their respective contact blade portions 143, 153. The interaction between the surface area and location of the ground and signal terminals is explained below. The mounting portions of the signal and ground terminals may also utilize through hole members 195 (FIG. 1A) for mounting purposes.

By this structure, each pair of the differential signal terminals of the cable or circuit have an individual ground terminal associated with them that extends through the connector, thereby more closely resembling both the cable and its associated plug connector from an electrical performance aspect. Such a structure keeps the signal wires of the cable "seeing" the ground not only in the same manner throughout not only the length of the cable, but also in substantially the same manner through the plug and receptacle connector to the circuit board.

The presence of an associated ground with the signal terminals importantly imparts controlled capacitive and inductive coupling between the three terminals. These coupling parameters affect the ultimate impedance of the terminals and their connector. The resistance, terminal material and self-inductance are also components that affect the overall impedance of the connector insofar as the triplet of terminals is concerned. In the embodiment shown in FIG. 5B, the width $D_2$ of the ground terminal blade portion 153' is large enough so that it extends over-portions of the signal terminals 140', 141'. The larger width $D_2$ of the ground terminal blade portion 153' has a larger surface area as compared to the signal terminal contact blade portions 143' and hence presents a larger contact mating area in the region above the signal terminals 140', 141'.

In order to preserve the small "footprint" of the receptacle connector 110 on the circuit board, the present invention reduces the width of the ground plane in the ground terminal body portion 154' as well as in the surface mount foot portions 152'. By reducing the width of the ground terminal 150' in its body portion 154' in the second plane thereof so that it may fit between the differential signal terminals, the distance between the signal terminals (TPA+ and TPA−) is also reduced to maintain a like coupling through the connector by maintaining a preselected substantially constant impedance between the ground terminal and the signal terminals. The impedance of the connector (as well as the coupling between the terminals) is affected by the spacing between the adjacent signal terminals 140', 141' as well as between the signal and ground terminals. Still further the material used between the terminals, such as air, the housing material, or a combination of both, will present a dielectric constant or a composite dielectric constant present between the signal and ground terminal.

Figure 5B:
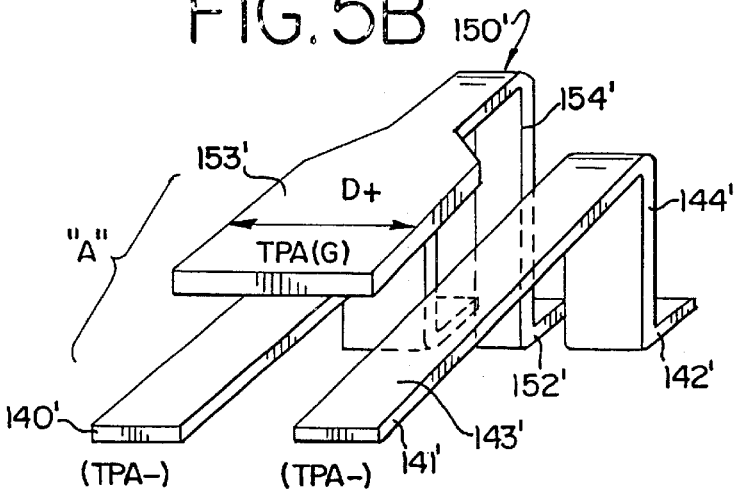
FIG. 5B is an enlarged detail view of another type of terminal triplet that may be used in the connector of FIG. 2.
Figure 5A:
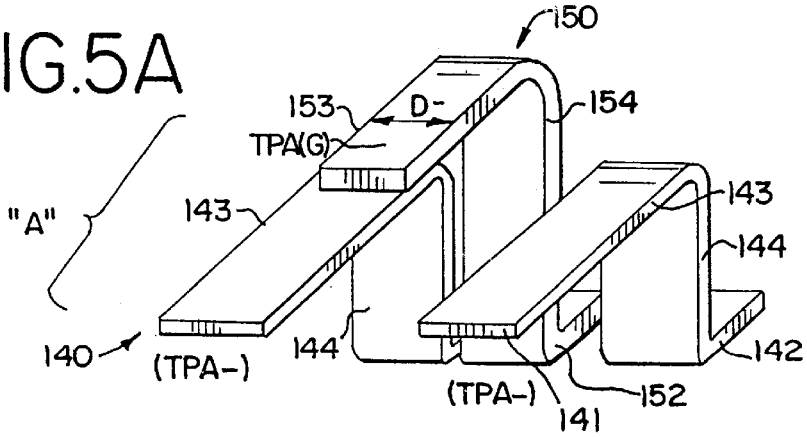
FIG. 5A is an enlarged detail view of a "triplet" group of terminals used in the connector of FIG. 2 illustrating the relative size and placement of two signal terminals and one ground terminal thereof.

By reducing the width of the ground terminal body portion 154' in the embodiment of FIG. 5B, the overlapping aspect between the contact blade portions 153', 143' of the ground and signal terminals stop in a first plane (shown as horizontal), but no longer overlap in the second, intersecting (vertical) plane. Rather, in this second plane the ground terminal body portion 154' is aligned with the signal terminals 144' in an edge-to-edge arrangement. Although there is less cross-sectional area of the ground terminal in these planes, the ground terminal is now closer to the signal terminals and hence like coupling between the terminal is maintained.

In the region of the first plane, namely that of the ground and signal terminal contact blade portions, the overall plate size of the ground terminal 150' is increased relative to that of the signal-terminals 140', 141' to thereby selectively diminish the impedance. Likewise, in the second plane, occupied by both the signal ground terminal body portions 144', 154', the spacing between the ground terminal 150' and the signal terminals 140', 141' is reduced so that the ground and signal terminals are brought closer together to thereby reduce the impedance of the connector. The signal ground terminal contact blade portions 143, 143' of the triplets are preferably maintained in the same plane as illustrated in FIGS. 5A & 5B, and along the lower leaf portion 114*a* of the connector housing 112. This notably permits the impedance of the connector to be tuned from a spacing aspect but also facilitates the mechanical engagement of the two connectors. By providing a ground terminal with a larger contact blade portion, the mating contact between such terminals and the opposing ground and signal terminals of the other (plug) connector is improved without detrimentally affecting impedance.

The effect of this tunability is explained in FIG. 11, in which a reduction in the overall impedance discontinuity occurring through the connector assembly is demonstrated. The impedance discontinuity that is expected to occur in the connectors of the present invention is shown by the dashed line 60 of FIG. 11. It will be noted that the magnitude of the peaks and valleys, $H_{11}$, $H_{22}$ and $H_{33}$ is greatly reduced. The present invention is believed to significantly reduce the overall discontinuity experienced in a conventional connector assembly. In one application, it is believed that the highest level of discontinuity will be about 135 ohms (at $H_{11}$) while the lowest level of discontinuity will be about 85 ohms (at $H_{22}$). The target baseline impedance of connectors of the invention will typically be about 110 ohms with a tolerance of about +/−25 ohms. It is contemplated therefore that the connectors of the present invention will have a total discontinuity (the difference between $H_{11}$ and $H_{22}$) and about 50 ohms, which results in a decrease from the conventional discontinuity of about 90 ohms referred to above of as much as almost 50%.

Figure 6:
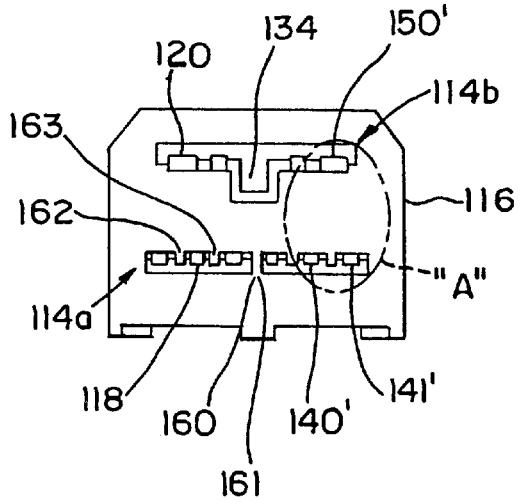
FIG. 6 is an end view taken along lines 6—6 of FIG. 3, but illustrating only the internal insulative body of the receptacle connector of FIG. 3.

The tunability and impedance characteristics may also be affected, as stated earlier by the dielectric between the terminals. In this regard, and as shown best in FIG. 6, the lower leaf portion 114*a* of the connector housing 112 may itself be slotted, as at 160 to form an air gap 161 between halves of the lower leaf portion 114*a*. Likewise, the signal (and other) terminals 140, 141 or 140', 141' may be separated from each other on the lower leaf portion 114*a* by a similar air gap 162 that is defined by a channel 163 formed in the lower leaf portion 114*a*. These channels 163, as seen in FIG. 6, extend only partially through the thickness of the lower leaf portion 114*a* so as to preserve the structural integrity of the lower leaf portion.

Figure 4:
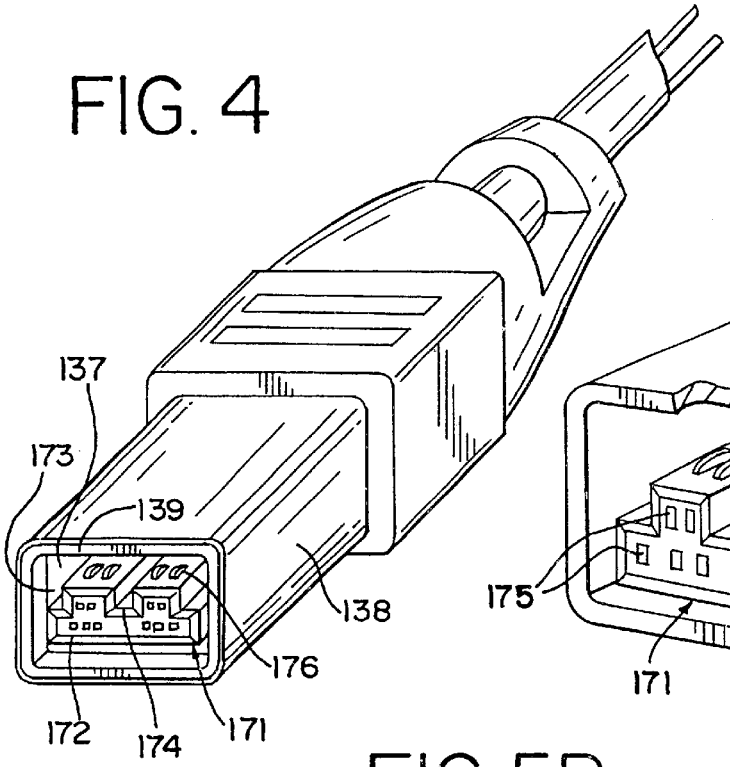
FIG. 4 is a perspective view of a cable with a plug connector terminated thereto for engagement with the socket connector of FIG. 2.
Figure 4A:
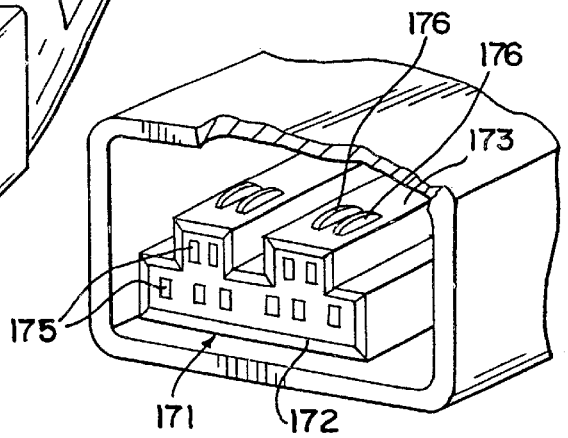
FIG. 4A is an enlarged end view of the plug-style connector of FIG. 4, with a portion of the connector cover broken away to better illustrate the terminal structure and location thereof.
Figure 9C:
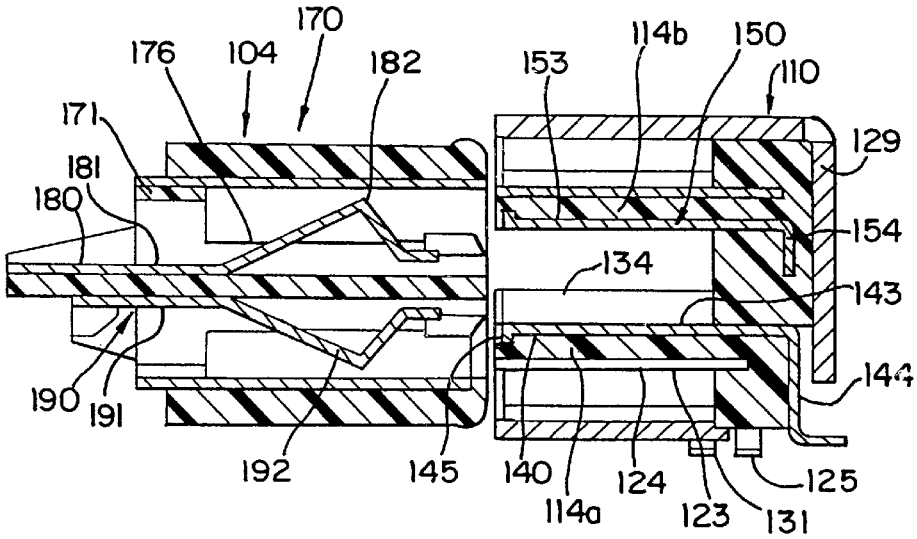
FIG. 9C is a cross-sectional view of two plug and receptacle connectors shown in a position preliminary to interengagement.
Figure 17:
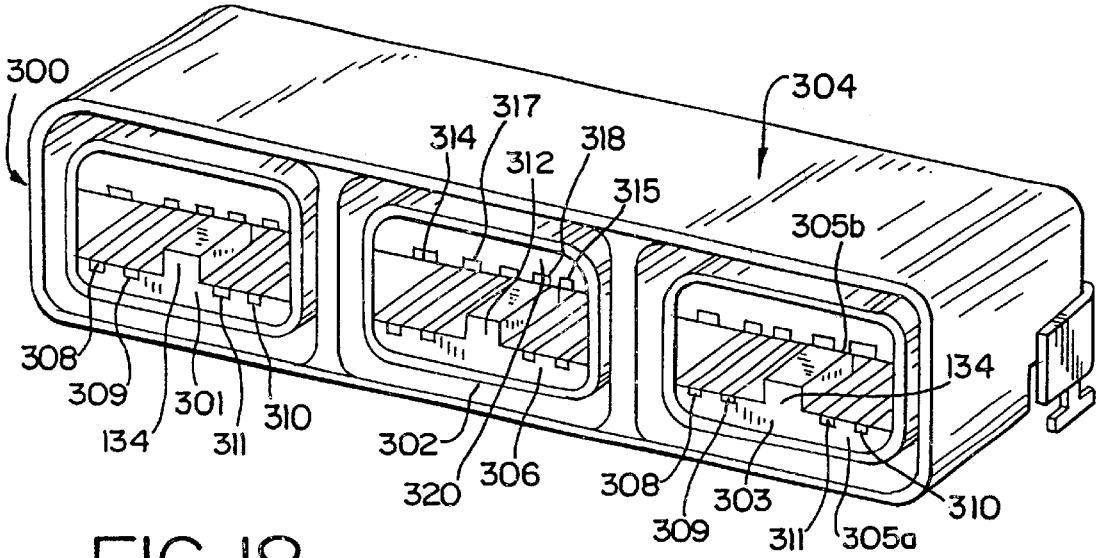
FIG. 17 is a perspective view of multiple socket-style connector in incorporating the principles of the present invention.

Turning now to FIGS. 4 and 4A, an opposing mating connector 104 is shown in the form of a plug connector 170 that has an insulative connector housing 171 formed from a dielectric material in a complimentary configuration to that of the receptacle connector 110 so as to facilitate and ensure the proper mating therebetween. In this regard, the connector housing 171 has a base portion 172 with two portions 173 that extend therefrom and which are separated by a gap 174 that serves as a keyway for the receptacle connector housing body key 134. This key 134 of the receptacle connector may be found on the upper leaf portion, as shown in FIGS. 2, 3, 6 and 7 or it may be formed on the lower leaf portion thereof as shown in FIGS. 9C and 17. The housing is hollow and contains signal, ground and other terminals held in internal cavities of the housing 171 (not shown).

Figure 10A:
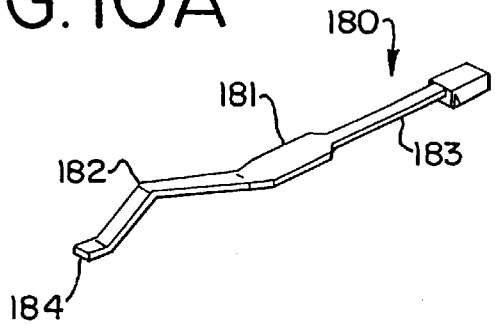
FIG. 10A is a perspective view of a ground terminal used in the plug-style connectors of the invention shown in FIGS. 4 and 12–14.
Figure 10B:
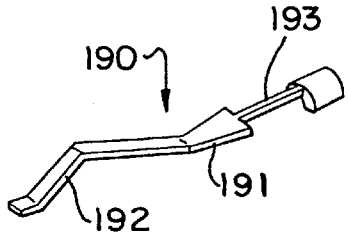
FIG. 10B is a perspective view of a signal terminal utilized in the plug-style connectors of the invention shown in FIGS. 4 and 12–14.

Two terminals are shown in FIGS. 10A and 10B which are representative of the type of terminal structure that is preferred for use in the plug connector 110. FIG. 10A illustrates a ground terminal 180 having a flat body portion 181 that interconnects a contact portion 182 to a termination portion 183. The terminal 180 has a free end 184 which is received in a cavity 175 at the end of the connector housing 171. The contact portion 182 is bent at an upward angle so that it will project out of a contact opening 176 in alignment with and in opposition to a corresponding ground terminal 150 or 150' of the receptacle connector 110.

The signal terminal 190 (FIG. 10B) is likewise structured and has a body portion 191 with a reduced width compared to that of the ground terminal body portion 181 in order to effect coupling between the signal and ground terminals. The body portion 191 interconnects a contact portion 192 with a termination portion 193 and the contact portion 192 is also bent at an angle to protrude through a corresponding opening 176 in the connector housing 171. These openings and the terminal contact portions appear on the bottom surface of the connector base portion 172 as shown in FIG. 9C and they are aligned with the terminal free end cavities 175 that are shown in the front face of the connector housing 171.

The grounded signal terminals 180, 190 of the plug connector 170 (as well as the other terminals) may be considered as "movable" contacts in that they are deflected toward the center of the plug connector housing 171 when the plug connector 170 is engaged with the receptacle connector 110. The grounded signal terminals 140, 141, 150 (as well as the other terminals) may be considered as "fixed" terminals because they do not move during engagement and disengagement of the two connectors. In the schematic views of FIGS. 9A and 9*b*, the solid rectangles represent the "movable" terminals described above, while the dashed rectangles adjacent to them represent the "fixed" terminals described above.

Status Information Aspect

In another important aspect of the present invention, a status information detection feature is provided in the connector assembly 100, and primarily resides in the connector 104 terminated to the cable 105. As mentioned earlier, high speed cables at present may be manufactured to operate at three distinct data transmission speeds of 800, 1600 and 3200 megabits per second. It is beneficial for the electronic device or computer to know what speed cable is being used so that it may utilize appropriate circuitry to handle the data transmitted in the most efficient manner. In this regard, and in the broadest sense, the connector assembly 100 of the invention is provided with a feature in place within the connector that permits it to identify and convey information to the circuit board about the status of the cable, such as its speed., It is contemplated that such status information not be limited to only the speed of the cable, but may include other information as to peripheral device and/or circuitry on the upstream side of the connector 104.

In one embodiment of this feature, and as shown in FIG. 9A, both of the connectors 104 and 110 are provided with a pair of status information terminals, labeled SD in FIG. 9A, for "speed detect." In the receptacle connector 110 that is mounted to the printed circuit board 102, one of the status information terminals will be connected to a ground in the circuit board, while the other of the two status information terminals will be connected to a specific circuit on the circuit board. As such, these two terminals and the receptacle connector 110 act only as a conduit to receive and transmit the status information from the plug connector 104 to the to circuit board circuitry.

Figure 12:
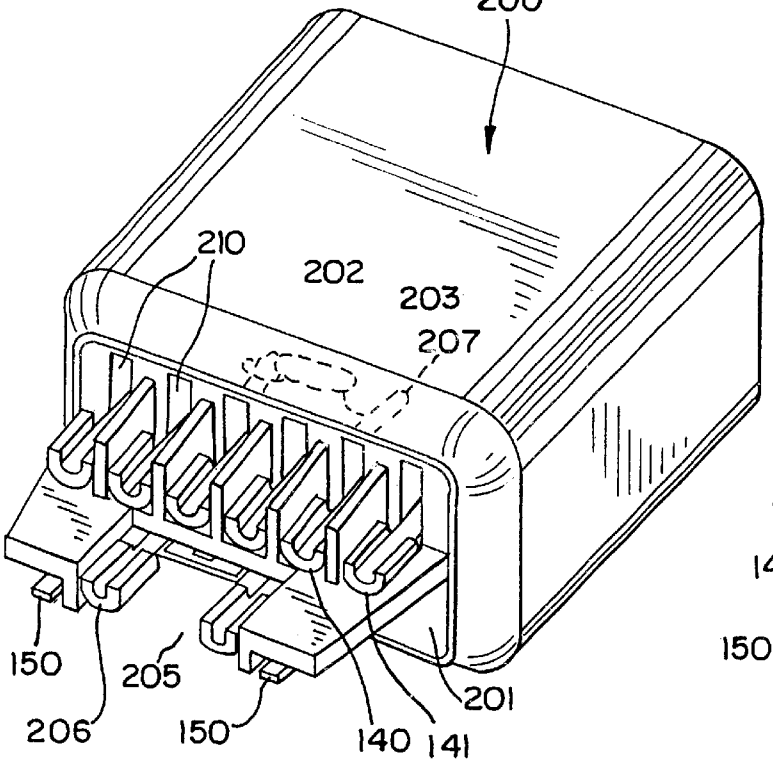
FIG. 12 is a perspective rear view of a plug-style of the invention with two status information terminals as is shown in FIGS. 4 and 4A.

A plug connector 200 using such a two status terminal feature is shown in FIG. 12. The rear face 201 of the plug connector 200 is illustrated to show the arrangement of the terminals. On the top row of the connector, a pair of status information terminals 202, 203 are held within and project rearwardly from a series of connector housing terminal-receiving openings 210. In this embodiment, the status information terminals 202, 203 are flanked by pairs of signal terminals 140, 141 that in turn, are positioned above associated ground terminals 150 and two power terminals 205, 206 which are respectively a power out (voltage) and a power return (ground) terminal. In this embodiment, a nest is formed (not shown) in the interior of the connector housing 171 that receives an electronic component 207 which is applied between the two status terminals. Also, this two-terminal status information embodiment is particularly suitable for instances where no power terminals are incorporated in the connector.

The component may be any suitable component such as a resistor, capacitor, resistor-capacitor, fuse, etc. that is suitable to modify a signal coming from the cable in a manner to indicate its status. This is further explained by referring to the second embodiment of this aspect.

Figure 13:
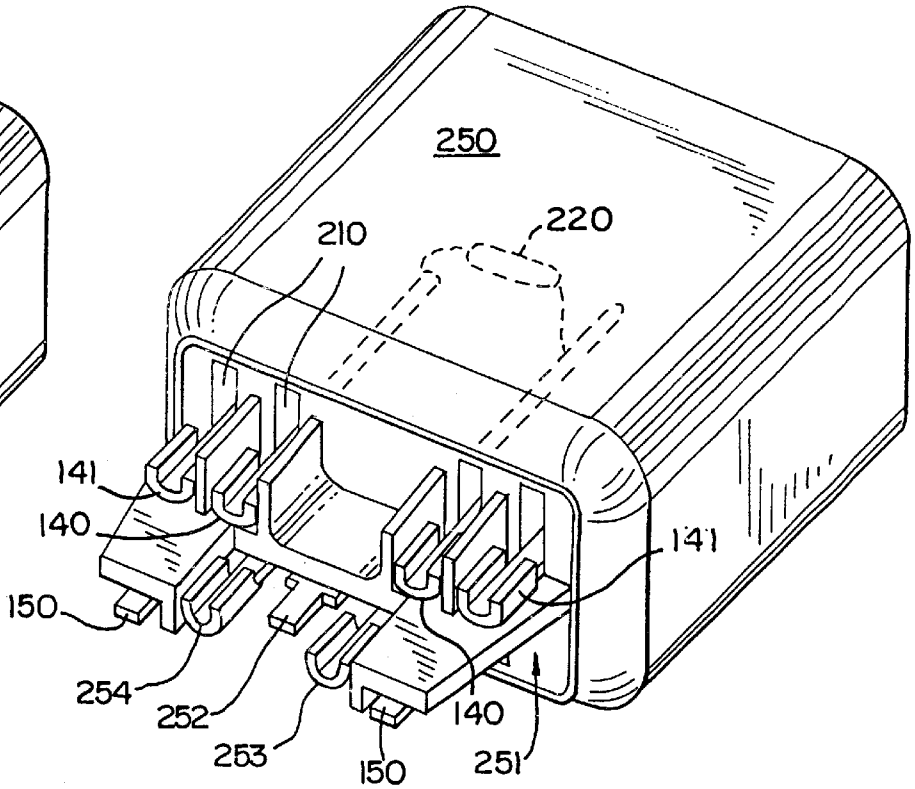
FIG. 13 is a perspective rear view of a plug-style connector of the invention having a single status information terminal as is shown in FIG. 9B.
Figure 14A:
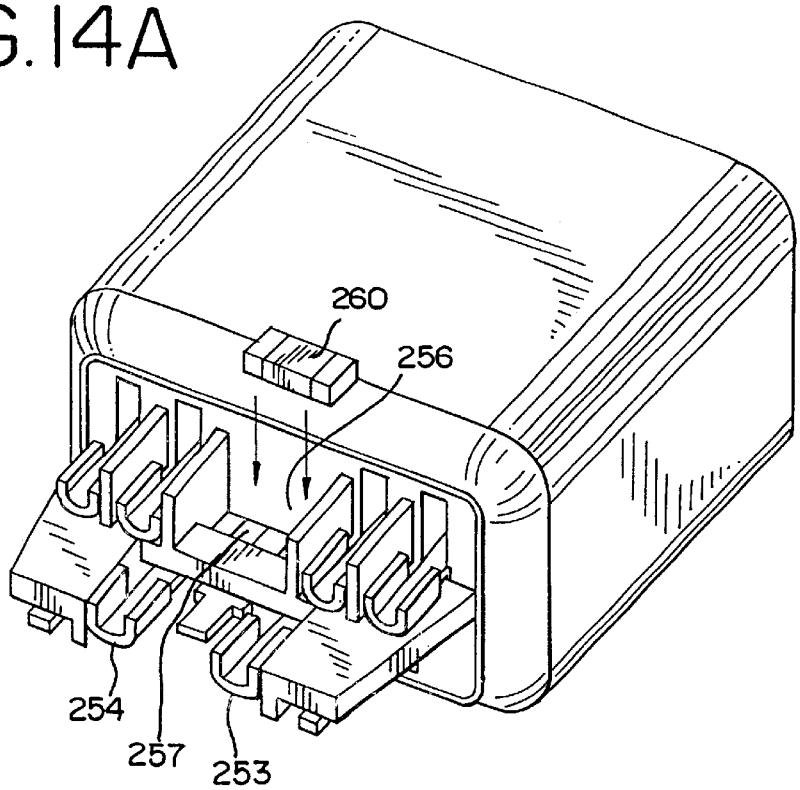
FIG. 14A is a perspective rear view of the plug-style connector of FIG. 13 modified to incorporate a nest for receiving an electronic component for bridging two terminals of the connector.
Figure 14B:
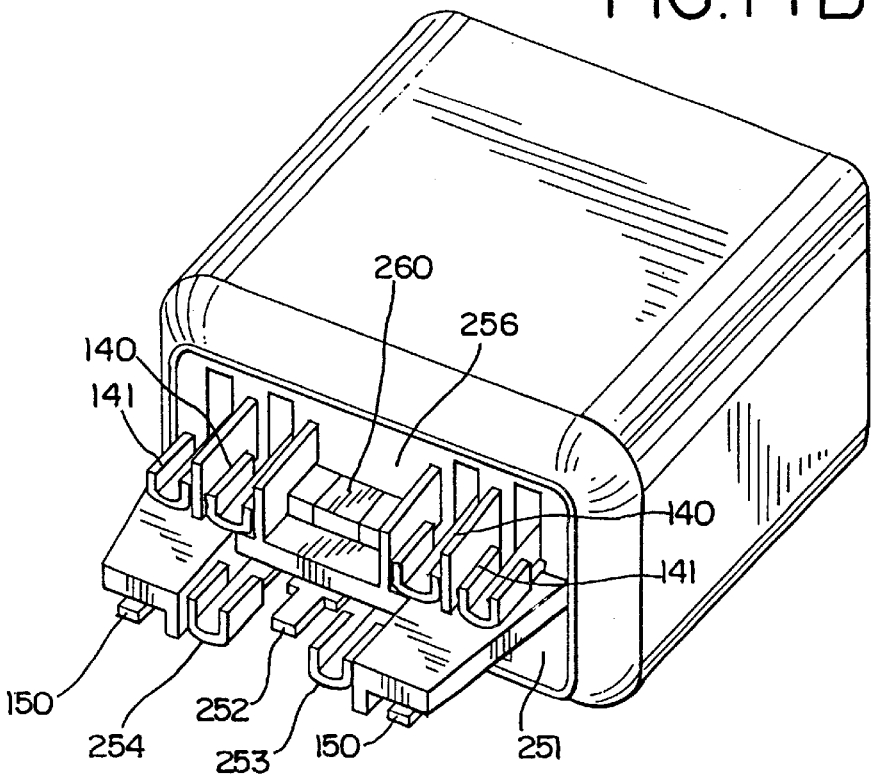
FIG. 14B is the same view as FIG. 14A, but illustrating the electronic component in place.

FIGS. 13, 14A & 14B illustrate another plug connector 250 having a single status information terminal 252 associated therewith.

FIG. 9B schematically shows the arrangement of terminals in this embodiment. The status information terminal 252 has been moved to the other row of terminals and is illustrated as interposed between the power out (PV) terminal 253 and the power return, or ground, (PG) terminal 254. As shown in FIG. 14A, a nest 256 may be formed in the connector housing 251 as a recess, or opening 257 that extends between and over the power ground terminal 254 and the status information terminal 252. This nest 256 is sized to receive an electronic component 260 that has two conductive portions 261, 262 on it, shown at opposite ends for electrically contacting the two terminals 252, 254.

Figure 15:
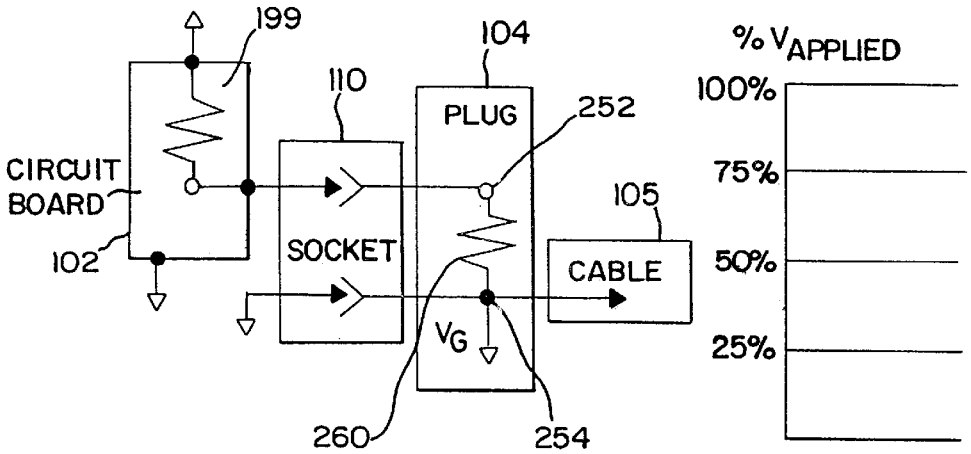
FIG. 15 is a schematic diagram illustrating the determination of status information by using a resistor as an electronic status sensing component.

The electronic component 260 may be a chip capacitor, a chip resistor, or a combination of the two in order to form an RC circuit, a fuse or the like. The component 260 bridges or shorts across the status information terminal 252 and the power ground terminal 254 in the embodiment shown so that signals transmitted through the status information terminal 252 may be modified to indicate a particular status. In this embodiment, the speed of the cable is the status information being conveyed to the circuit board of the device. In instances where the electronic component 260 is a resistor, as illustrated in FIG. 15, the status circuit 199 can read the resultant voltage as seen at through the status information terminal 252. The voltage signal for each speed cable will display a different resultant voltage at the status information terminal 252, in predetermined percentages based upon the value of the resistive component 260 incorporated in the plug connector housing 250.

Figure 16:
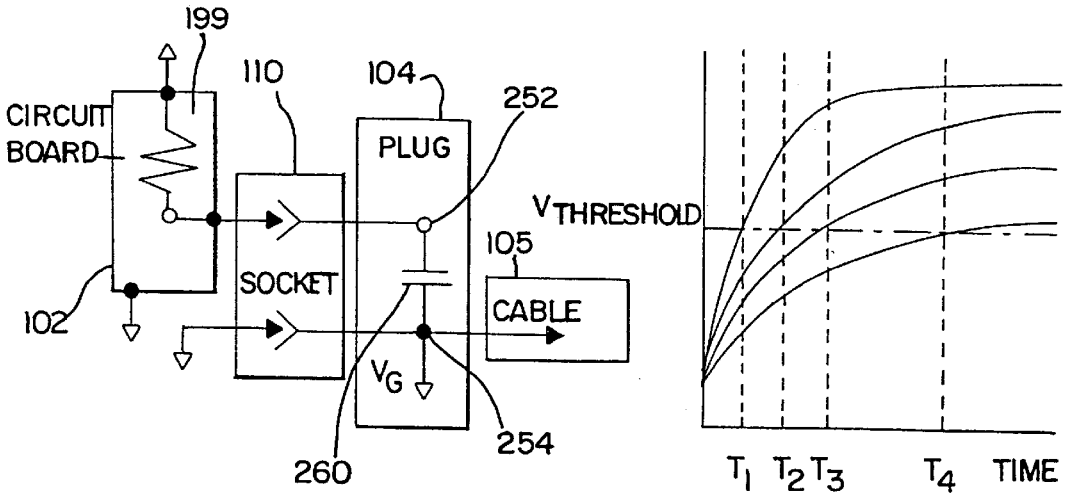
FIG. 16 is a schematic diagram illustrating the determination of status information by using a capacitor as an electronic status sensing component.

Similar information may be read when the component 260 is a capacitor as shown in FIG. 16 and the time it takes in the voltage passing through the status information terminal 252 to rise to a certain threshold level may be counted by the status circuit 199 of the circuit board 102. Different speed cables will have different times for reaching this threshold voltage.

The aforementioned uses are examples of the use of a "passive" component used in the plug connector 104 for association with the status information terminal 252. It is contemplated that the privileges of the present invention may also encompass the use of an "active" electronic component in order to increase the range of status information recognition by the connector such as a fuse, a switch or the like that may indicate the power condition of the peripheral device or other relevant information. In both such instances, the status,information terminal is part of a circuit formed within the plug or cable connector that is completed when the connector is mated with an opposing, mating connector having a complimentary status information terminal that is terminated to a status circuit on the circuit board. As such, the present invention removes the status aspect from the circuit board and moves it into the plug or cable connector. Such a status information terminal is not terminated at all to any component of the cable in that it is provided to complete an off-connector circuit. Such a terminal will be incorporated in the connectors at both ends of the cable.

The embodiments shown in the drawings illustrate the status information terminal 252 being bridged to the power return (ground) terminal 254. Certain benefits are obtained by this structure, such as the isolation of the status information circuit on the circuit board and minimizing radiated emissions off of the overall connector assembly which would occur if the status information terminal were shorted to the connector shell (ground). By connecting the status information terminal 252 to an internal ground 254 of the connector 104, the signals on it are entirely contained within the system and are less susceptible to the inducement of noise.

One could also short the status information terminal 252 to one of the signal pair grounds 150, but to do so would bring the signals transmitted through the status information terminal 252 close to at least one of the differential signal pairs where it might affect the signal integrity by inducing noise into one or both of the differential pair. However, this construction could be used in instances where no power ground is present as what might be experienced in a board-to-board connector application.

Additionally, by locating the status information (SD) and power (PV, PG) terminals in one location and row of the connector housing (where the available space is limited), it is possible to bring the differential signal pairs closer together and keep them "quiet" from an "electrical noise" perspective. This closeness permits the connectors to accomplish their goals using the minimum mechanical structure and maintain the size of the connector.

An example of this signal isolation and of the incorporation of multiple connectors of the invention is shown generally as 300 in FIG. 17, wherein three individual receptacle connectors 301, 302, 303 arranged in an inline configuration within an external shielding shell 304. Each receptacle connector 301–303 has two leaf portions 305*a*, 305*b* that support conductive terminals 306. The signal terminals of these connectors are arranged in two discrete and differential pairs of terminals 308, 309, 310, 311. Each such terminal pair is separated by a key 312 formed as part of the connector housing body. The ground terminals 314, 315 associated with the signal pairs are located on the upper leaf portion 305*b* and are aligned with their associated signal pairs as previously mentioned. The remaining terminals on the upper row may include power out and return terminals 317, 318 that are disposed between the ground terminals 314, 315 and a status information terminal 320 that is shown interposed between the power terminals 317, 318.

Connector Isolation

As mentioned previously, and as illustrated in FIG. 2, inner shield 123 on the receptacle connector 110 is isolated from the external shield 129 by an intervening isolator member 130. There are distinct advantages to such a novel double shield construction. For example, a communicating electrical network may be established between the inner and outer shields, that may include one or more electrical devices to effect a predetermined electrical relationship between the inner and outer shields.

For example, the electrical network could utilize a capacitor and provide a means for AC current to flow between the inner and outer shields while blocking DC current. Alternatively, an RC network could be utilized having a resistor to dissipate ESD charge and the capacitor to shunt AC noise currents to the outer shell and subsequently to the conductive case of the equipment, thus minimizing radiated emissions.

In other applications other electrical components such as metal oxide varistors (MOV's) could be employed to provide over voltage protection and controlled spark gaps could provide a predetermined arc-over path for extreme voltage transient conditions. Other components and variations of components could be employed to provide a wide variety of additional functions.

Traditionally, these functions have been undertaken by circuitry on the printed circuit board which takes up valuable space on the circuit card. In the case of high speed and extreme speed interfaces, this circuitry increases path length and thereby typically reduces the quality of the function.

Figure 18:
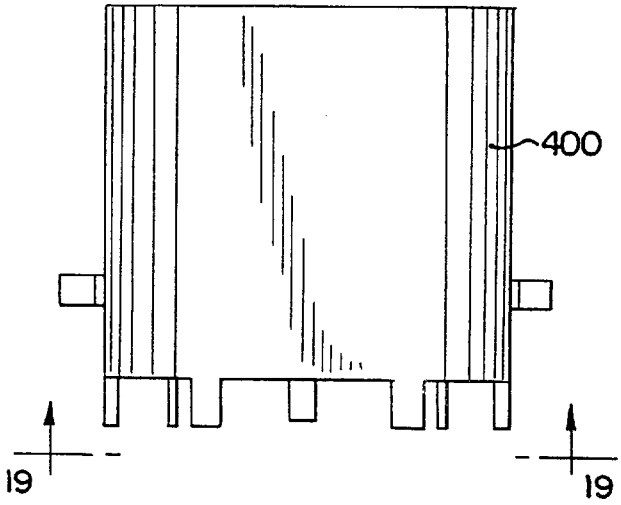
FIG. 18 is a top plane view of one connector of FIG. 2 in a partly assembled state.
Figure 19:
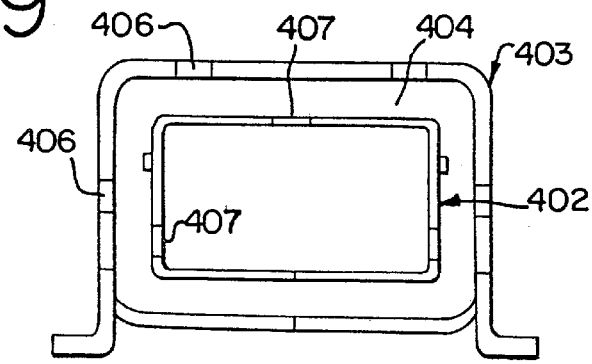
FIG. 19 is an end view of the connector of FIG. 18 taken along lines 19—19 thereof.
Figure 20:
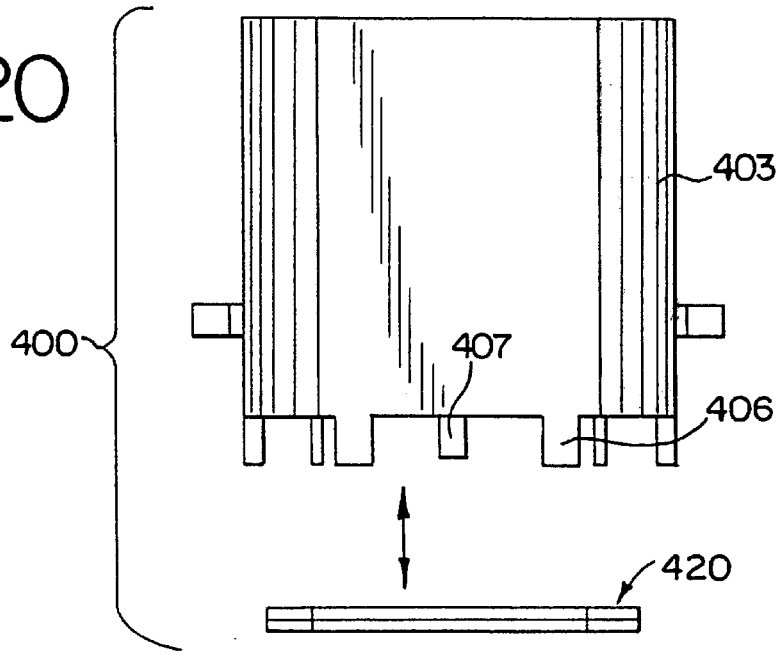
FIG. 20 is a top plan view of the connector of FIG. 18, illustrating how a circuit board is attached to the two shields.
Figure 21:
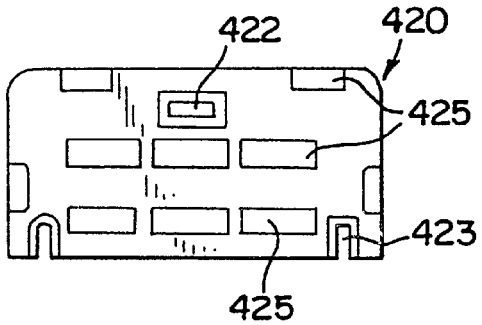
FIG.21 is a plan view of the circuit board of FIG. 20.
Figure 22:
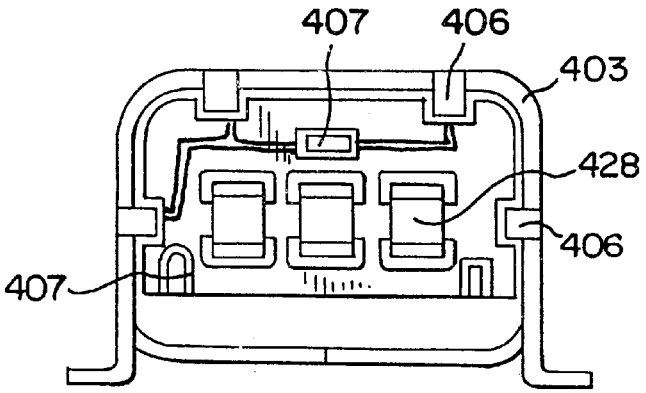
FIG. 22 is an end view of the connector of FIG. 20 showing the circuit board attached to both shields.
Figure 23:
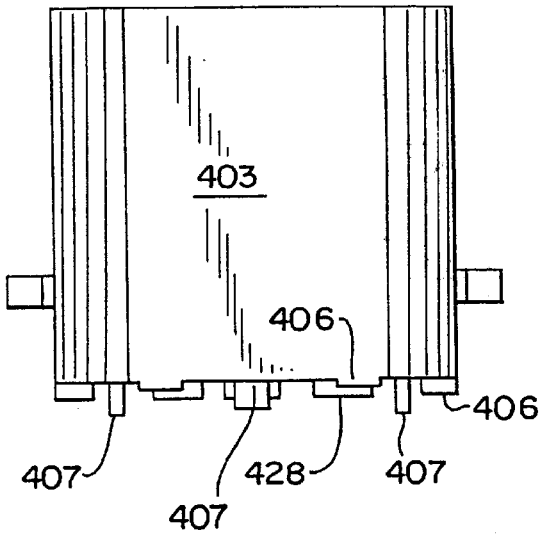
FIG. 23 is a top plan view of the connector of FIG. 22 showing the means of attachment.
Figure 24:
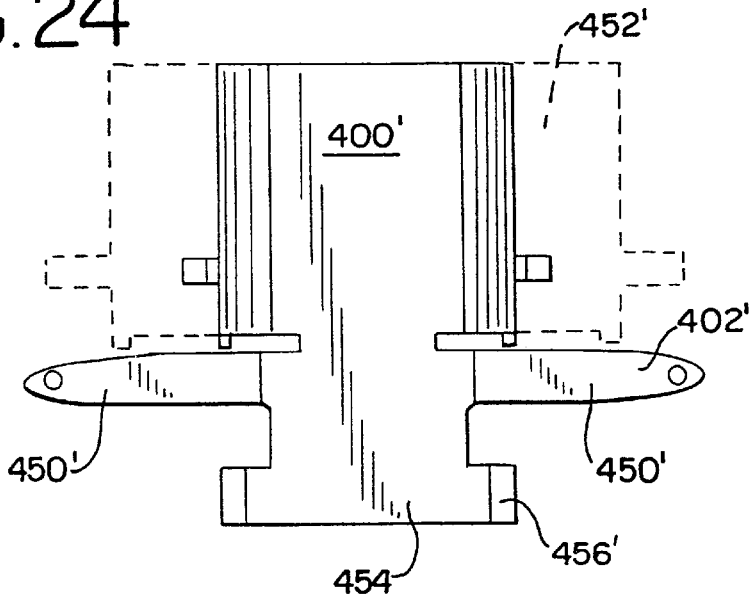
FIG. 24 is a plan view of a metal blank (in phantom) and to form an integral inner and outer shield assembly for use with connectors of the invention.

Turning now to FIG. 18, one embodiment of such a double shield structure 400 is shown in plan view. As shown in FIG. 19, the inner shield 402 is enclosed within the outer shield 403 and is separated from it by an intervening insulator 404. Each shield 402, 403 may be provided with connector tabs 406, 407 which may be used to electrically interconnect the two shields together.

A network may be used to interconnect the two shields together. The network (such as a capacitor or other component) may be connected, for example, directly to the two shields. In the embodiment of FIGS. 20—23, some form of flexible circuitry, rigid printed circuit board, 3D printed wiring board 420 or the like is directly attached to the connector and to the two shields 402, 403 thereby saving space on the circuit board 102 and reducing electrical path length thus improving the quality of the function.

The circuit member 420 may include cutouts 422, 423 that receive the tabs 406, 407 of the two shields 402, 403. The circuit member 420 is shown as having solder pads 425 to which either the tabs 406 or the electronic components 428 are attached.

A network may be used to interconnect the shields together. The methods (such as a capacitor or other component) connected, for example, directly to the two shields. In the embodiment of FIGS. 20–23, some form of flexible circuitry, rigid printed circuit board, 3D printed wiring board 420 or the like is directly attached to the connector and to the two shields 402, 403 thereby saving space on the circuit board 102 and reducing electrical path length thus improving the quality of the function.

The circuit member 420 may include cutouts 422, 423 that will view the tabs 406, 407 of the two shields 402, 403. The circuit member 420 is shown as having solder pads 425 to which either the tabs 406 or the electronic components 428 are attached.

Figure 25:
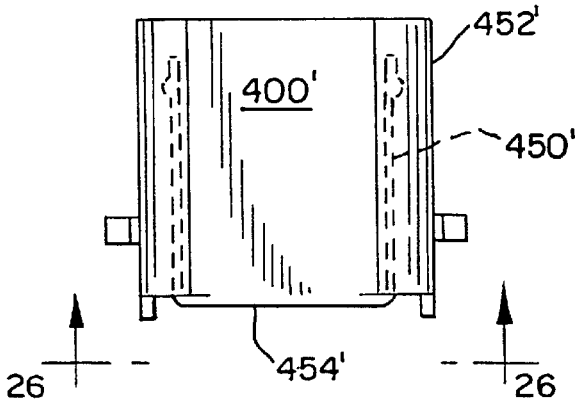
FIG. 25 is a top plan view of the blank of FIG. 24 formed into a double shield assembly.
Figure 26:
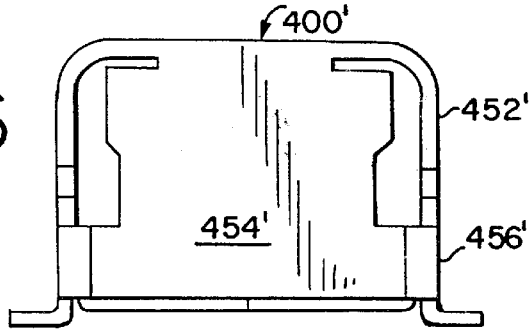
FIG. 26 is an end view of FIG. 25 taken along lines 26—26 thereof.

In the embodiment of FIGS. 23–26, a metal blank 400' may be used to form the two shields 402', 403' as an integral assembly that provides a direct electrical contact between the two shields 402', 403'. As shown in FIG. 25, the inner shield portions 450' are folded in the manner shown so that they lie interior of and spaced apart from the side walls 452', which are folded from the dashed line position of FIG. 24 to the final configuration of FIG. 26. A rear plate 454' with tabs 456' is provided for further connection.

Figure 27:
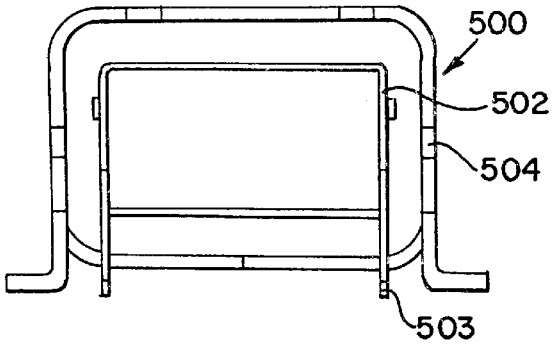
FIG. 27 is an end view of another embodiment of a double shield connector assembly of the invention.
Figure 28:
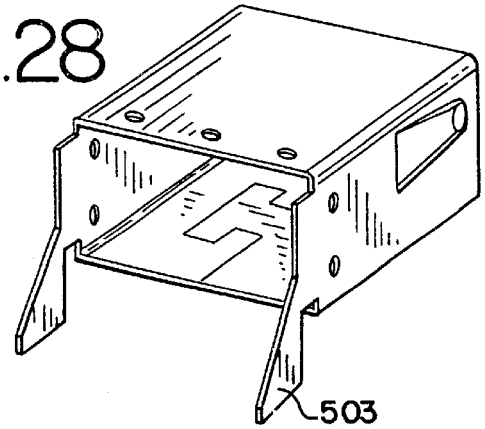
FIG. 28 is a perspective view of the inner shield used in the assembly of FIG. 27.
Figure 29:
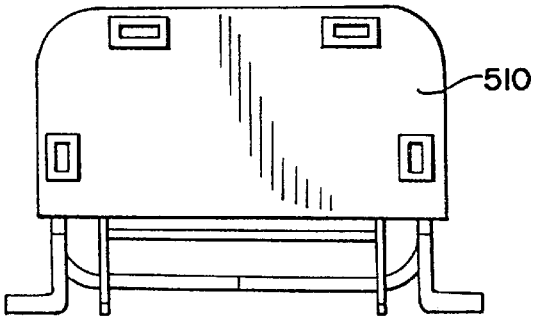
FIG. 29 is an end view of the assembly of FIG. 27 in an assembled and closed state.

In an additional embodiment of this invention, shown generally as 500 in FIGS. 27–29, the inner shield 502 is formed separately with mounting feet 503 (shown as surface mounting feet). The inner shield 502 is positioned interior of the outer shield 504. In this embodiment, as well as that of FIGS. 18 and 19, the two shields may be connected directly to the circuit board or other structure and thereby give the system assembler a choice in the type of communication between the shields to obtain a desired level of control. A shorting plate 510 may be applied to the outer shield in order to bridge over the outer and inner shields.

Shorting of the Power Terminals

In another important aspect of the present invention, and as exemplified by another embodiment thereof, the two power terminals, PV and PG, are capacitively coupled together within the connector housing of either the plug connector 104 or the receptacle connector 110. This coupling provides the connector assembly with at least the following advantages: (1) it minimizes noise caused by spurious AC voltages from being transferred from the circuit board through the connector; (2) it establishes a common ground reference for parasitic coupling from the signal terminals in order to minimize any AC voltage gradients occurring between ground and power terminals, PV and PG; and (3) it protects the connector from induced voltage "noise" from exterior electronic devices.

Noise voltage induced on the power terminals PV, PG will tend to affect the differential pair terminals TPA+, TPA−, TPB+, TPB−. By placing a capacitor (220) between the two power terminals PV 205, 253 and PG 206, 254 it is possible to keep the power terminals at the same AC potential in a dynamic condition of high speed data transmission. The effect of this coupling is to minimize any noise voltage between the voltage power and ground terminals PV and PG in order to minimize noise coupled to the signal terminals.

Although the description has largely been described in terms of a cable to circuit board connector assembly, it will be understood that the present invention is not so limited. The connectors of the present invention may be used as "docking" connectors, such as those used to connect an electronic device such as a computer to a base station, or to connect two computers together. This invention may also be incorporated into board-to-board style connectors where impedance matching or status information is desired.

While the preferred embodiments, of the invention have been shown and described, it will be apparent to those skilled in the art that changes and modifications may be made therein without departing from the spirit of the invention, the scope of which is defined by the appended claims.

We claim:

1. A double shielded connector, comprising:

a connector housing supporting a plurality of conductive terminals, a first conductive shield surrounding at least a portion of the connector housing, a second conductive shield spaced apart from the first conductive shield to define a space between said first and second conductive shields, said second conductive shield surrounding at least a portion of said first conductive shield, and each of said first and second conductive shields including respective contact tabs projecting therefrom, a dielectric interposed in said space between said first and second conductive shields, the dielectric electrically isolating said first and second conductive shields; and, an electrical network interconnecting the first and second conductive shields, the electrical network including a support member extending between opposing sides of said second conductive shield, the support member including at least a pair of conductive traces that are electrically connected to said first and second conductive shield contact tabs and which electrically connect said first and second conductive shields together.

2. The double shielded connector of claim 1, wherein said electrical network is an active network.

3. The double shielded connector of claim 1, wherein said electrical network is a passive network.

4. The double shielded connector of claim 1, wherein said support member includes at least one opening formed therein, and said first conductive shield contact tab extends through the one opening into contact with one of said support member conductive traces.

5. The double shielded connector of claim 1, wherein said electrical network includes at least one electronic component mounted to said support member and interconnecting said support member conductive traces.

6. The double shielded connector of claim 1, wherein said first and second conductive shields remain isolated after a mating connector is mated with said double shielded connector.

7. The double shielded connector of claim 5, wherein said electronic component is chosen from the group consisting essentially of: a capacitor, an RC network and a metal oxide varistor.

8. The double shielded connector of claim 1, wherein said support member includes a rigid printed circuit board.

9. The double shielded connector of claim 1, wherein said support member includes a 3D printed wiring board.

10. The double shielded connector of claim 1, wherein said support member includes an extent of flexible circuitry.

11. The double shielded connector of claim 1, wherein said support member extends across the rear of said second conductive shield.

* * * * *